US010983455B2

(12) United States Patent
Mitsunobu

(10) Patent No.: US 10,983,455 B2
(45) Date of Patent: Apr. 20, 2021

(54) IMAGE FORMING APPARATUS PERFORMING RETURN CONTROL USING ENVIRONMENTAL HISTORY INFORMATION

(71) Applicant: Oki Data Corporation, Tokyo (JP)

(72) Inventor: Hidetaka Mitsunobu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/820,931

(22) Filed: Mar. 17, 2020

(65) Prior Publication Data

US 2020/0310287 A1 Oct. 1, 2020

(30) Foreign Application Priority Data

Mar. 29, 2019 (JP) ..... JP2019-067174

(51) Int. Cl.
*G03G 15/08* (2006.01)
*G03G 15/00* (2006.01)
*G03G 21/20* (2006.01)

(52) U.S. Cl.
CPC ..... *G03G 15/0863* (2013.01); *G03G 15/5016* (2013.01); *G03G 21/20* (2013.01)

(58) Field of Classification Search
USPC ..... 399/44
See application file for complete search history.

(56) References Cited

U.S. PATENT DOCUMENTS

2012/0002987 A1* 1/2012 Odani ..... G03G 21/20 399/44
2016/0320746 A1* 11/2016 Makino ..... G03G 21/20

FOREIGN PATENT DOCUMENTS

JP 2010-072246 A 4/2010

* cited by examiner

*Primary Examiner* — Q Grainger
(74) *Attorney, Agent, or Firm* — Muncy, Geissler, Olds & Lowe, P.C.

(57) ABSTRACT

An image forming apparatus includes an apparatus main body and a replacement unit that is detachable to the apparatus main body. The replacement unit includes a first sensor that detects first environmental information that is an ambient environment of the replacement unit, and a recording part that records the first environmental information as environmental history information, the apparatus main body includes a second sensor that detects second environmental information that is another ambient environment of the apparatus main body, and a control part that controls the replacement unit based on the environmental history information and the second environmental information, when the replacement unit is attached to the apparatus main body, the control part performs a return control based on the environmental history information, which is obtained before the replacement unit is attached, and the second environmental information.

19 Claims, 8 Drawing Sheets

*Fig. 8*

Memory Record Info. 1
2018. 10. 17 08:30:00, 58%RH, 23 ℃
2018. 10. 17 09:30:00, 20%RH, 10 ℃
2018. 10. 17 10:30:00, 20%RH, 10 ℃
Memory Record Info. 2
2018. 10. 17 03:30:00, 80%RH, 29 ℃
2018. 10. 17 04:30:00, 82%RH, 28 ℃
2018. 10. 17 05:30:00, 81%RH, 29 ℃
2018. 10. 17 06:30:00, 80%RH, 28 ℃
2018. 10. 17 07:30:00, 80%RH, 28 ℃
2018. 10. 17 08:30:00, 81%RH, 29 ℃
2018. 10. 17 09:30:00, 83%RH, 28 ℃
2018. 10. 17 10:30:00, 81%RH, 29 ℃
Memory Record Info. 3
2018. 10. 17 08:30:00, 40%RH, 54 ℃
2018. 10. 17 09:30:00, 35%RH, 52 ℃
Memory Record Info. 4
2018. 10. 17 08:30:00, 16%RH, 23 ℃
2018. 10. 17 09:30:00, 15%RH, 22 ℃

*Fig. 9*

Temp. [C˚]
Humidity [%RH]

| | 10 or Less | 10~15 | 15~20 | 20~25 | 25~30 | 30 or More |
|---|---|---|---|---|---|---|
| 20 or Less | −800 | −800 | −800 | −785 | −785 | −770 |
| 20~30 | −800 | −800 | −785 | −785 | −770 | −770 |
| 30~40 | −800 | −785 | −785 | −770 | −770 | −770 |
| 40~50 | −785 | −785 | −770 | −770 | −770 | −755 |
| 50~60 | −785 | −770 | −770 | −770 | −755 | −755 |
| 60~70 | −780 | −770 | −770 | −755 | −755 | −740 |
| 70~80 | −780 | −770 | −755 | −755 | −740 | −740 |
| 80 or More | −780 | −755 | −755 | −740 | −740 | −740 |

(Unit Volt.)

Fig. 11

| Humidity [%RH] \ Temp. [C°] | 10 or Less | 10–15 | 15–20 | 20–25 | 25–30 | 30 or More |
|---|---|---|---|---|---|---|
| 20 or Less | −180 | −180 | −180 | −180 | −190 | −190 |
| 20–30 | −180 | −180 | −180 | −190 | −190 | −190 |
| 30–40 | −180 | −190 | −190 | −190 | −190 | −200 |
| 40–50 | −190 | −190 | −200 | −200 | −200 | −200 |
| 50–60 | −200 | −200 | −200 | −210 | −210 | −210 |
| 60–70 | −210 | −210 | −210 | −210 | −220 | −220 |
| 70–80 | −210 | −220 | −220 | −220 | −220 | −220 |
| 80 or More | −220 | −220 | −220 | −220 | −220 | −220 |

(Unit Volt.)

Fig. 12

| ΔT(°C) | Return Control |
|---|---|
| 5°C≦ΔT<10°C | TWN: 5 |
| 10°C≦ΔT<15°C | TWN: 10 |
| 15°C≦ΔT<20°C | TWN: 15 |
| ΔT≧20°C | TWN: 20 |

Fig. 13

| ΔT(°C) | Return Control |
|---|---|
| −10°C<ΔT≦−5°C | ΔCH=−4V |
| −15°C<ΔT≦−10°C | ΔCH=−8V |
| −20°C<ΔT≦−15°C | ΔCH=−12V |
| ΔT≦−20°C | ΔCH=−16V |

*Fig. 14*

| ΔH(%RH) | Return Control |
|---|---|
| 10%RH < ΔH ≦ 20%RH | ΔCH=+4V |
| 20%RH < ΔH ≦ 30%RH | ΔCH=+8V |
| 30%RH < ΔH ≦ 40%RH | ΔCH=+12V |
| ΔH ≧ 50% | ΔCH=+16V |

*Fig. 15*

| ΔH(%RH) | Return Control |
|---|---|
| -20%RH ≦ ΔH < -10%RH | ΔSB=+5V |
| -30%RH ≦ ΔH < -20%RH | ΔSB=+10V |
| -40%RH ≦ ΔH < -30%RH | ΔSB=+15V |
| ΔH ≦ -50% | ΔSB=+20V |

IMAGE FORMING APPARATUS PERFORMING RETURN CONTROL USING ENVIRONMENTAL HISTORY INFORMATION

TECHNICAL FIELD

This invention relates to an image forming apparatus such as a printer or copier with an electrophotographic system.

BACKGROUND

Among conventional image forming apparatuses there is an electrophotographic image forming apparatus that forms an image by fusing prescribed toner to a recording medium. Such an image forming apparatus performs an image formation by forming an electrostatic latent image on a charged photosensitive drum by an exposure means, supplying toner from a supply roller to a development roller, developing a toner image by having the toner on the development roller as a developer carrier adhere to the electrostatic latent image formed on the photosensitive drum as an electrostatic latent image carrier, primary-transferring the developed toner image to an intermediate transfer belt, secondary-transferring the toner image held on the intermediate transfer belt onto the recording medium, and fusing the toner image on the recording medium by a fuser means. In such an image forming apparatus, when printing by attaching a development device that was left alone outside the image forming apparatus, there was a problem that fogging of the printed image worsened. Therefore, in order to avoid fogging, the image formation was performed by measuring the left-alone time and idling the development device according to the left-alone time.

RELATED ART

[Patent Doc. 1] JP Laid-Open Patent Application Publication 2010-72246

However, in a conventional technology, when a replacement unit comprising a photosensitive drum, a supply roller, and a development roller is left alone outside the image forming apparatus, image troubles may occur based on the environment where it was left alone.

This invention has an objective of solving such a problem and aims at obtaining high quality images with no image troubles even when its replacement unit is left alone for a long time.

SUMMARY

An image forming apparatus, disclosed in the application, includes an apparatus main body and a replacement unit that is detachable to the apparatus main body. The replacement unit includes a first sensor that detects first environmental information that is an ambient environment of the replacement unit, and a recording part that records the first environmental information as environmental history information, the apparatus main body includes a second sensor that detects second environmental information that is another ambient environment of the apparatus main body, and a control part that controls the replacement unit based on the environmental history information and the second environmental information, when the replacement unit is attached to the apparatus main body, the control part performs a return control based on the environmental history information, which is obtained before the replacement unit is attached, and the second environmental information.

This invention made in this manner has an objective of solving such a problem and can obtain high quality images with no image troubles even when its replacement unit is left alone for a long time.

BRIEF DESCRIPTION OF THE DRAWINGS

FIG. 8 is a list showing an example of memory record information of a temperature/humidity recording part in the first embodiment.

FIG. 9 is a table explaining charging voltage (CH) for temperature and humidity of the image forming apparatus.

FIG. 11 is a table explaining supply voltage (SB) for temperature and humidity of the image forming apparatus.

FIG. 12 is a table explaining the return control when a temperature difference detected by the image forming apparatus and its replacement unit in the second embodiment is $\Delta T>0$.

FIG. 13 is a table explaining the return control when the temperature difference detected by the image forming apparatus and the replacement unit in the second embodiment is $\Delta T<0$.

FIG. 14 is a table explaining the return control when a humidity difference detected by the image forming apparatus and the replacement unit in the second embodiment is $\Delta H>0$.

FIG. 15 is a table explaining the return control when the humidity difference detected by the image forming apparatus and the replacement unit in the second embodiment is $\Delta H<0$.

DETAILED DESCRIPTION OF THE PREFERRED EMBODIMENT(S)

Below, embodiments of the image forming apparatus by this invention are explained referring to drawings.

Embodiment 1

Figure 1:
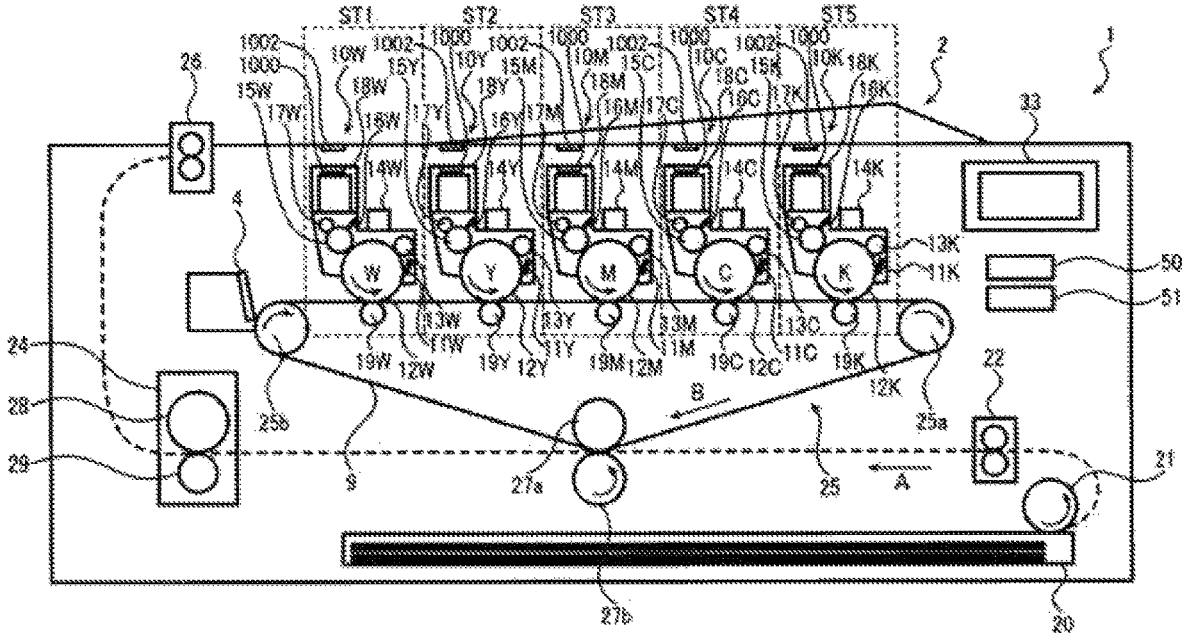
FIG. 1 is an outline side cross-sectional view of an image forming apparatus in the first embodiment.

FIG. 1 is an outline side cross-sectional view of an image forming apparatus 1 in the first embodiment. In FIG. 1, the image forming apparatus 1 is an electrophotographic printer or the like that performs printing by forming toner images as developer images on a print medium, such as an electrophotographic color printer that forms an image with toners as developers in five colors of black (K), yellow (Y), magenta (M), cyan (C), and white (W).

Note that although explanations in this embodiment are given dealing with white (W) as a special color, another colors such as clear, fluorescent cyan, fluorescent magenta, fluorescent yellow, gold, or silver may be dealt with. Note that although explained in this embodiment is the image forming apparatus 1 having an intermediate transfer system that primary-transfers toner images formed by image forming parts 10 to an intermediate transfer belt 9, and secondary-transfers the toner images primary-transferred to the intermediate transfer belt 9 to the print medium, the image forming apparatus 1 can have a direct transfer system that directly transfers the toner images formed by the image forming parts 10 to a medium. Also, it can be an electrophotographic color printer that forms images with toners as developers in four colors of cyan (C), yellow (Y), magenta (M), and white (W). This invention can also be implemented as a monochrome printer having only black (K) color.

The image forming apparatus 1 has a plurality of image forming parts 10 (10W, 10Y, 10M, 10C, and 10K), a sheet cassette 20, a sheet feeding roller 21, a carrying roller unit 22, a reading part 1002, a transfer belt unit 25, a secondary transfer roller 27*b*, a fuser unit 24, an ejection roller unit 26, an operation/display part 33, a temperature sensor 50, and a humidity sensor 51. The sheet cassette 20 accommodates the print media in a stacked state.

Here, as the print medium in this embodiment, transfer paper, plain paper, or the like is used. The transfer paper is a medium for transferring to a shirt. For example, toner fused on transfer paper is transferred to a shirt or the like by heat of an iron or the like. As the plain paper, white plain paper or colored (such as black, blue, or red) plain paper is used.

The sheet feeding roller 21 rotates in a direction indicated with an arrow in the figure, thereby separating and forwarding a piece of the print media accommodated in the sheet cassette 20. The carrying roller unit 22 carries the print medium forwarded by the sheet feeding roller 21 in a medium carrying direction indicated with an arrow A in the figure. The carrying roller unit 22 is a roller pair that nip-holds the print medium and carries it in the medium carrying direction by rotating.

The image forming parts 10W, 10Y, 10M, 10C, and 10K form toner images in five colors of white (W), yellow (Y), magenta (M), cyan (C), and black (K), respectively.

Replacement units ST (ST1, ST2, ST3, ST4, and ST5) are disposed sequentially from the upstream side to the downstream side in the carrying direction (rotational travel direction indicated with an arrow B in the figure) of the intermediate transfer belt 9 of the transfer belt unit 25 in the order of the replacement unit ST1 configured of the image forming part 10W and a toner cartridge 18W, the replacement unit ST2 configured of the image forming part 10Y and a toner cartridge 18Y, the replacement unit ST3 configured of the image forming part 10M and a toner cartridge 18M, the replacement unit ST4 configured of the image forming part 10C and a toner cartridge 18C, and the replacement unit ST5 configured of the image forming part 10K and a toner cartridge 18K.

Figure 2:
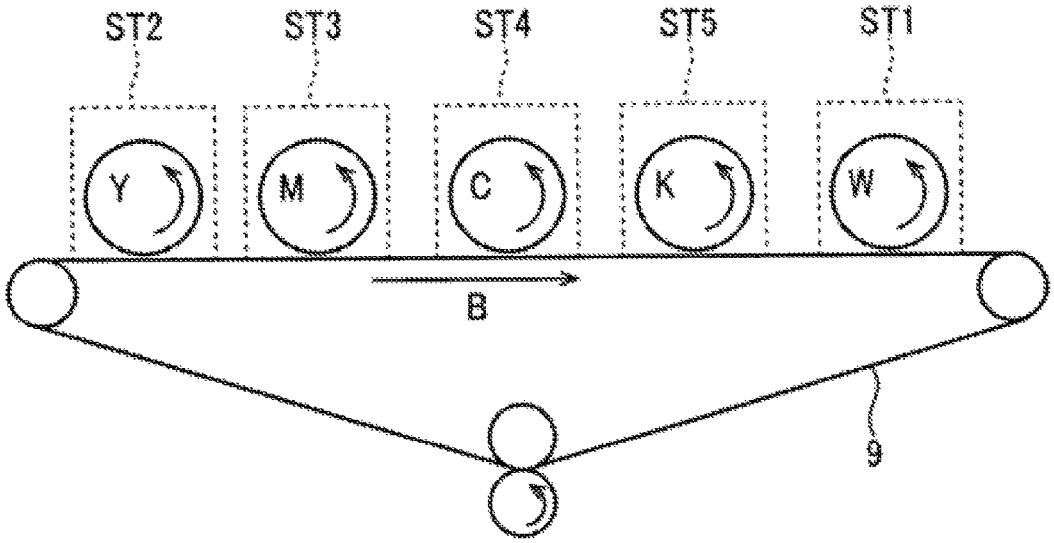
FIG. 2 is an explanatory diagram of an array of image forming parts in the first embodiment.

Also, as shown in FIG. 2, they can also be disposed sequentially from the upstream side to the downstream side in the carrying direction (rotational travel direction indicated with an arrow B in the figure) of the intermediate transfer belt 9 of the transfer belt unit 25 in the order of the replacement unit ST2, the replacement unit ST3, the replacement unit ST4, the replacement unit ST5, and the replacement unit ST1. In this embodiment, the replacement units ST1, ST2, ST3, ST4, and ST5 are configured detachable and replaceable for the image forming apparatus 1 as the apparatus main body, allowing exchange and rearrangement.

Note that the replacement units ST1, ST2, ST3, ST4, and ST5 can be exchanged to change their arrangement within the same image forming apparatus 1, or the replacement units can be made exchangeable between different models of the image forming apparatuses 1.

The image forming parts 10W, 10Y, 10M, 10C, and 10K have photosensitive drums 12W, 12Y, 12M, 12C, and 12K, charging rollers 13W, 13Y, 13M, 13C, and 13K, development rollers 15W, 15Y, 15M, 15C, and 15K, development blades 16W, 16Y, 16M, 16C, and 16K, supply rollers 17W, 17Y, 17M, 17C, and 17K, and cleaning blades 11W, 11Y, 11M, 11C, and 11K, respectively. Also, LED (Light Emitting Diode) heads 14W, 14Y, 14M, 14C, and 14K are disposed opposing the photosensitive drums 12W, 12Y, 12M, 12C, and 12K of the image forming parts 10W, 10Y, 10M, 10C, and 10K, respectively.

The photosensitive drums 12W, 12Y, 12M, 12C, and 12K as image carriers carry electrostatic latent images and toner images, and are supported rotatable in a rotation direction indicated with an arrow in the figure by the image forming parts 10W, 10Y, 10M, 10C, and 10K, respectively. The photosensitive drums 12W, 12Y, 12M, 12C, and 12K rotate by a rotational drive of an unshown photosensitive drum motor.

The charging rollers 13W, 13Y, 13M, 13C, and 13K as charging parts uniformly charge the surfaces of the photosensitive drums 12W, 12Y, 12M, 12C, and 12K, respectively. The LED heads 14W, 14Y, 14M, 14C, and 14K selectively expose the surfaces of the photosensitive drums 12W, 12Y, 12M, 12C, and 12K charged by the charging rollers 13W, 13Y, 13M, 13C, and 13K for each pixel (dot), forming electrostatic latent images on the surfaces of the photosensitive drums 12W, 12Y, 12M, 12C, and 12K, respectively.

The development rollers 15W, 15Y, 15M, 15C, and 15K as development parts carry toners to the electrostatic latent images formed on the surfaces of the photosensitive drums 12W, 12Y, 12M, 12C, and 12K, respectively, thereby developing the electrostatic latent images as toner images. The supply rollers 17W, 17Y, 17M, 17C, and 17K as supply parts supply toners to the development rollers 15W, 15Y, 15M, 15C, and 15K, respectively.

The development blades 16W, 16Y, 16M, 16C, and 16K as layer forming means form toner thin layers by regulating toner layers supplied to the development rollers 15W, 15Y, 15M, 15C, and 15K.

Gears are installed on one end of the rotation shafts of the photosensitive drums 12W, 12Y, 12M, 12C, and 12K, the development rollers 15W, 15Y, 15M, 15C, and 15K, and the supply rollers 17W, 17Y, 17M, 17C, and 17K, and the gears of the development rollers 15W, 15Y, 15M, 15C, and 15K, and the supply rollers 17W, 17Y, 17M, 17C, and 17K are configured so as to engage with the gears of the photosensitive drums 12W, 12Y, 12M, 12C, and 12K, respectively.

Therefore, the development rollers 15W, 15Y, 15M, 15C, and 15K, and the supply rollers 17W, 17Y, 17M, 17C, and 17K rotate interlocking with the rotations of the photosensitive drums 12W, 12Y, 12M, 12C, and 12K. After the toner images formed on the photosensitive drums 12W, 12Y, 12M, 12C, and 12K are transferred to the intermediate transfer belt 9 of the transfer belt unit 25, the cleaning blades 11W, 11Y, 11M, 11C, and 11K scrape off and remove toners remaining on the photosensitive drums 12W, 12Y, 12M, 12C, and 12K, respectively.

Together with the image forming parts 10W, 10Y, 10M, 10C, and 10K, the toner cartridges 18W, 18Y, 18M, 18C, and 18K as accommodation parts constitute the replacement units ST1, ST2, ST3, ST4, and ST5, respectively.

Also, the toner cartridges 18W, 18Y, 18M, 18C, and 18K are toner tanks that store toners, and supply the stored toners to the supply rollers 17W, 17Y, 17M, 17C, and 17K, respectively. Note that the configurations of the toner cartridges 18W, 18Y, 18M, 18C, and 18K are mentioned below.

Figure 3:
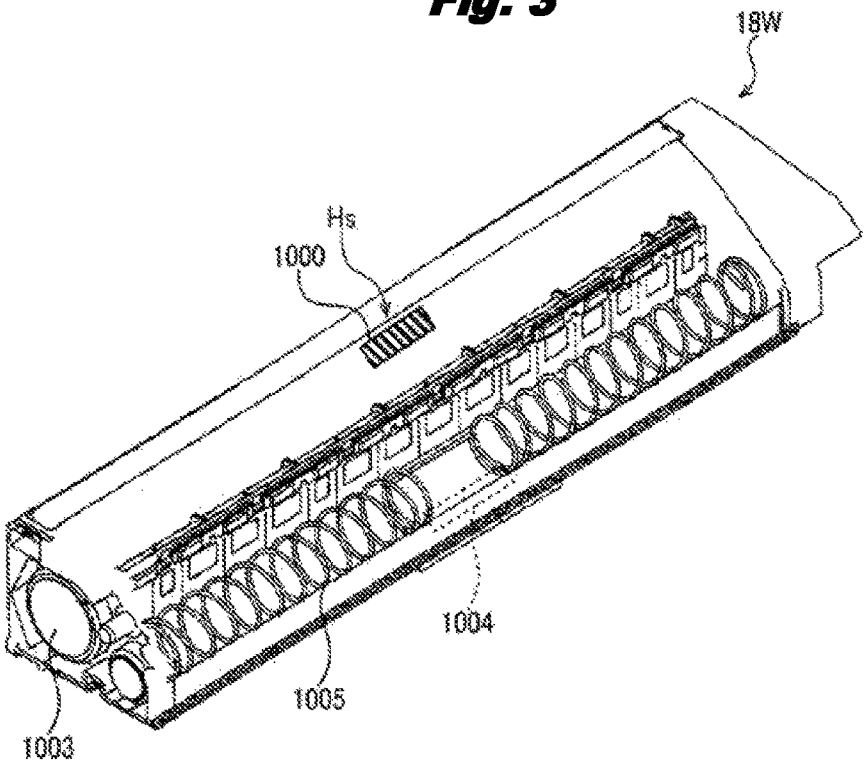
FIG. 3 is a perspective view of a toner cartridge with a temperature/humidity sensor attached in the first embodiment.

FIG. 3 is a perspective view of the toner cartridge 18W with a temperature/humidity sensor 1000 attached in the first embodiment. In FIG. 3, the toner cartridge 18W constituting the replacement unit ST1 is provided with a shutter 1003 installed freely rotatable in a toner accommodation chamber formed inside a case Hs, and if the shutter 1003 is rotated by an unshown lever installed on one end, toner inside the toner accommodation chamber is ejected through a toner supply port 1004 formed in the center of the lower end of the case Hs, and is supplied to the image forming part 10W. Note that a spiral 1005 as a stirring member is installed freely rotatable inside the case Hs, and once the spiral 1005 is rotated, toner inside the toner accommodation chamber is stirred, moved from both ends of the toner accommodation chamber to the central part, and ejected through the toner supply port 1004.

Also, attached to the toner cartridge 18W constituting the replacement unit ST1 is the temperature/humidity sensor 1000. The temperature/humidity sensor 1000 as a first sensor is a sensor to detect temperature and humidity that constitute the ambient environment of the replacement unit ST1 as first environmental information. Note that the temperature/humidity sensor 1000 is configured of a temperature sensor 103 and a humidity sensor 104 mentioned below.

Here, the reading part 1002 of the image forming apparatus 1 is disposed so as to oppose the temperature/humidity sensor 1000 attached to the toner cartridge 18W constituting the replacement unit ST1, and reads temperature and humidity detected by the temperature/humidity sensor 1000 (see FIG. 1).

Note that although explanations are given in this embodiment assuming that the temperature/humidity sensor 1000 is attached to the central part of the toner cartridge 18W, the attaching position is not limited as far as the reading part 1002 of the image forming apparatus 1 can read temperature and humidity detected by the temperature/humidity sensor 1000 attached to the replacement unit ST1. The sensor 1000 may be placed at a side, a top, or bottom of the cartridge.

Also, the temperature/humidity sensor 1000 can be given a structure detachable from the toner cartridge 18W constituting the replacement unit ST1, thereby making it attachable to the replacement unit ST2, ST3, ST4, or ST5 configured respectively of the toner cartridge 18Y, 18M, 18C, or 18K that accommodates a color other than the special color.

Also, although explanations are given in this embodiment assuming that the temperature/humidity sensor 1000 is attached to the replacement unit ST1 configured of the toner cartridge 18W that accommodates the special color (white) having particularly high frequency of replacement, it can also be attached to the replacement unit ST2, ST3, ST4, or ST5 configured of the toner cartridge 18Y, 18M, 18C, or 18K that accommodates yellow (Y), magenta (M), cyan (C), or black (K) other than the special color, respectively.

Figure 4:
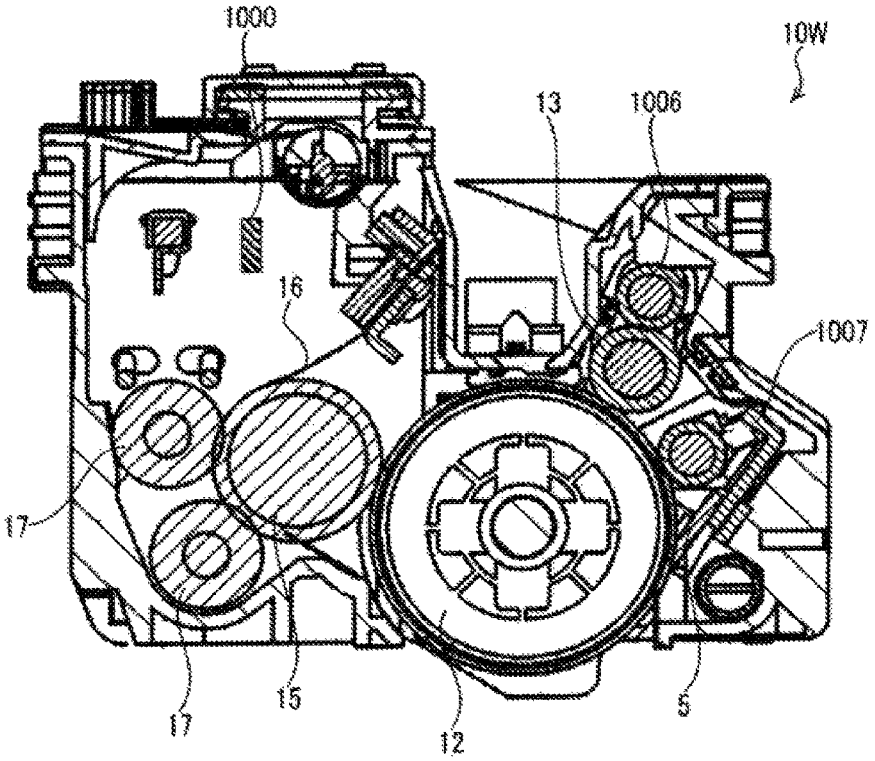
FIG. 4 is an outline side cross-sectional view of an image forming part with the temperature/humidity sensor attached in the first embodiment.

As a modification example, as shown in FIG. 4, the temperature/humidity sensor 1000 can be attached to the side end part of the image forming part 10W constituting the replacement unit ST1. Note that FIG. 4 is an outline side cross-sectional view of the image forming part 10W with the temperature/humidity sensor 1000 attached in the first embodiment. Also, although explanations are given in the modification example assuming that the temperature/humidity sensor 1000 is attached to the side end part of the image forming part 10W constituting the replacement unit ST1, the attaching position is not limited as far as the reading part 1002 of the image forming apparatus 1 can read temperature and humidity detected by the temperature/humidity sensor 1000.

Each of the toners in five colors of black (K), yellow (Y), magenta (M), cyan (C), and white (W) used is composed of a polyester resin, a coloring agent, a charging control agent, and a release agent, has an external additive (hydrophobic silica) added, and has a pulverized shape of 6 μm in average particle size obtained by a pulverization method. Note that toners made by a publicly known manufacturing method such as a polymerization method can be used as well. Organic pigments are used as the black (K), yellow (Y), magenta (M), and cyan (C) coloring agents, and a metallic pigment such as titanium dioxide in white color is used as the white (W) coloring agent.

Also, regarding fluorescent toners, listed as fluorescent magenta are SX1037 (manufactured by Shinloihi Co., Ltd.), SX-100 series, and SX-1000 series, where listed as the SX-100 series are SX-101 Red Orange, SX-103 Red, SX-104 Orange, SX-117 Pink, SX-127 Rose, etc., and as the SX-1000 series are SX-1004 Orange, SX-1007 Pink, SX-1037 Magenta, etc. Listed as fluorescent yellow are SX-100 series and SX-1000 series, where listed as the SX-100 are SX-105 Lemon Yellow and SX-106 Orange Yellow, and as the SX-1000 series are SX-1005 Lemon Yellow, etc. For fluorescent cyan and fluorescent white, toners are obtained by mixing a fluorescent brightening agent Tinopal OB CO (manufactured by BASF Japan ltd.) and employing a pulverization method. Also, gold and silver toners contain a bright pigment made of aluminum.

Each of the development rollers 15W, 15Y, 15M, 15C, and 15K is configured installing an elastic body on the outer circumference of a metallic shaft. For example, used as the elastic body on the metallic shaft is a semiconductive urethane rubber of 70 degrees in rubber hardness (Asker C). Each of the supply rollers 17W, 17Y, 17M, 17C, and 17K is configured by installing a foam on the outer circumference of a metallic shaft. For example, molded as the foam on the metallic shaft is a silicone foam of 50 degrees in rubber hardness (Asker F).

Each of the photosensitive drums 12W, 12Y, 12M, 12C, and 12K comprises a photosensitive layer part that is a photosensitive layer applied on a conductive supporting body processed into a cylindrical shape, and the photosensitive layer part has a lamination structure configured of a blocking layer, a charge generation layer, and a charge transportation layer in that order from the surface of the conductive supporting body. In this embodiment, the charge transportation layer was applied so as to become about 18 μm in thickness. Note that the film thickness was measured using an eddy-current film thickness gauge (Eddy-current Coating Thickness Tester LH-200J) manufactured by Kett Electric Laboratory.

The transfer belt unit 25 has drive rollers 25*a* and 25*b*, a secondary transfer opposing roller 27*a*, the intermediate transfer belt 9, primary transfer rollers 19W, 19Y, 19C, 19M, and 19K, and a belt cleaning blade 4.

The intermediate transfer belt 9 as a transfer medium on which toner images are formed is where toner images formed on the photosensitive drums 12W, 12Y, 12M, 12C, and 12K of the image forming parts 10W, 10Y, 10M, 10C, and 10K are primary-transferred to, and carries the primary-transferred toner images. The intermediate transfer belt 9 is an endless belt stretched rotatably over the drive rollers 25*a* and 25*b* and the secondary transfer opposing roller 27*a*.

The drive rollers 25*a* and 25*b* stretch the intermediate transfer belt 9, and are driven by an unshown motor or the like to rotate in a direction indicated with an arrow in the figure, thereby having the intermediate transfer belt 9 rotationally travel in a belt carrying direction indicated with the arrow B in the figure. The secondary transfer opposing roller 27*a* stretches the intermediate transfer belt 9, and also contacts the below-mentioned secondary transfer roller 27*b* through the intermediate transfer belt 9, forming a secondary transfer nip part between it and the secondary transfer roller 27*b*.

The primary transfer rollers 19W, 19Y, 19C, 19M, and 19K as transfer parts are disposed opposing the respective photosensitive drums 12W, 12Y, 12M, 12C, and 12K through the intermediate transfer belt 9, and primary-transfer toner images formed on the respective photosensitive drums 12W, 12Y, 12M, 12C, and 12K to the intermediate transfer belt 9 by having prescribed primary transfer voltages applied. The intermediate transfer belt 9 rotates in a belt traveling direction, thereby carrying the primary-transferred toner images to the secondary transfer nip part.

The belt cleaning blade 4 is disposed so as to contact the intermediate transfer belt 9 in the downstream of the secondary transfer nip part in the belt traveling direction, and scrapes off and removes toners remaining on the intermediate transfer belt 9 after the secondary transfer. In this manner, in the replacement units ST1, ST2, ST3, ST4, and ST5 of this embodiment, the image forming parts 10W, 10Y, 10M, 10C, and 10K form toner images on the intermediate transfer belt 9 as a transfer medium using toners accommodated in the toner cartridges 18W, 18Y, 18M, 18C, and 18K, respectively.

The secondary transfer roller 27*b* as a secondary transfer part is disposed opposing the secondary transfer opposing roller 27*a* of the transfer belt unit 25 through the intermediate transfer belt 9 in the downstream of the carrying roller unit 22 in the medium carrying direction, rotates in a direction indicated with an arrow in the figure, thereby carrying in the medium carrying direction the print medium carried by the carrying roller unit 22, and secondary-transfers to the print medium the toner images transferred to the intermediate transfer belt 9. This secondary transfer roller 27*b* secondary-transfers to the print medium the toner images transferred to the intermediate transfer belt 9 by a prescribed secondary transfer voltage being applied.

The secondary transfer roller 27*b* is configured of a metallic shaft, foamed urethane or the like that is given conductivity of about $10^7$~$10^9$ Ω·cm in volume resistivity. On the other hand, the secondary transfer opposing roller 27*a* of the transfer belt unit 25 is configured of a metallic roller. The metallic shaft of the secondary transfer roller 27*b* is connected with a below-mentioned secondary transfer control part through a fixed resistor for suppressing transfer failure occurrences due to resistance variation in the circumferential direction of the secondary transfer roller 27*b*. On the other hand, the metallic roller of the secondary transfer roller 27*a* of the transfer belt unit 25 is grounded.

Also, the secondary transfer roller 27*b* rotates in a direction indicated with the arrow in the figure, driven by a secondary transfer motor that is an unshown drive source. Furthermore, the secondary transfer roller 27*b* presses the intermediate transfer belt 9 against the secondary transfer opposing roller 27*a* of the transfer belt unit 25, forming the secondary transfer nip part between it and the secondary transfer opposing roller 27*a* and the intermediate transfer belt 9.

The fuser unit 24 as a fuser part has a heat application roller 28 and a pressure application roller 29, carries the print medium in the medium carrying direction, and fuses the toner images transferred to the print medium with heat and a pressure. The heat application roller 28 internally has a heat generating body such as a halogen lamp, and heats the toner images transferred to the print medium. The pressure application roller 29 is arranged opposing the heat application roller 28, and presses the toner images transferred to the print medium against the heat application roller 28.

The ejection roller unit 26 ejects the print medium carried from the fuser unit 24 to the outside of the apparatus. The ejection roller unit 26 is a roller pair that nip-holds and carries the print medium in the medium carrying direction and ejects it to the outside of the image forming apparatus 1 by rotating. The print medium ejected to the outside of the image forming apparatus 1 by the ejection roller unit 26 is accumulated on an ejection cassette 2.

The operation/display part 33 has an operation part with keys, buttons, a touch panel, etc. to accept an operator's input operation, and a display part such as a display to display various information such as the state of the image forming apparatus 1 and input operation guidance. The operation/display part 33 of this embodiment displays a message instructing to leave the replacement unit ST1 mentioned below.

The temperature sensor 50 and the humidity sensor 51 as second sensors are sensors to detect temperature and humidity that constitute the ambient environment of the image forming apparatus 1 as second environmental information.

Figure 5:
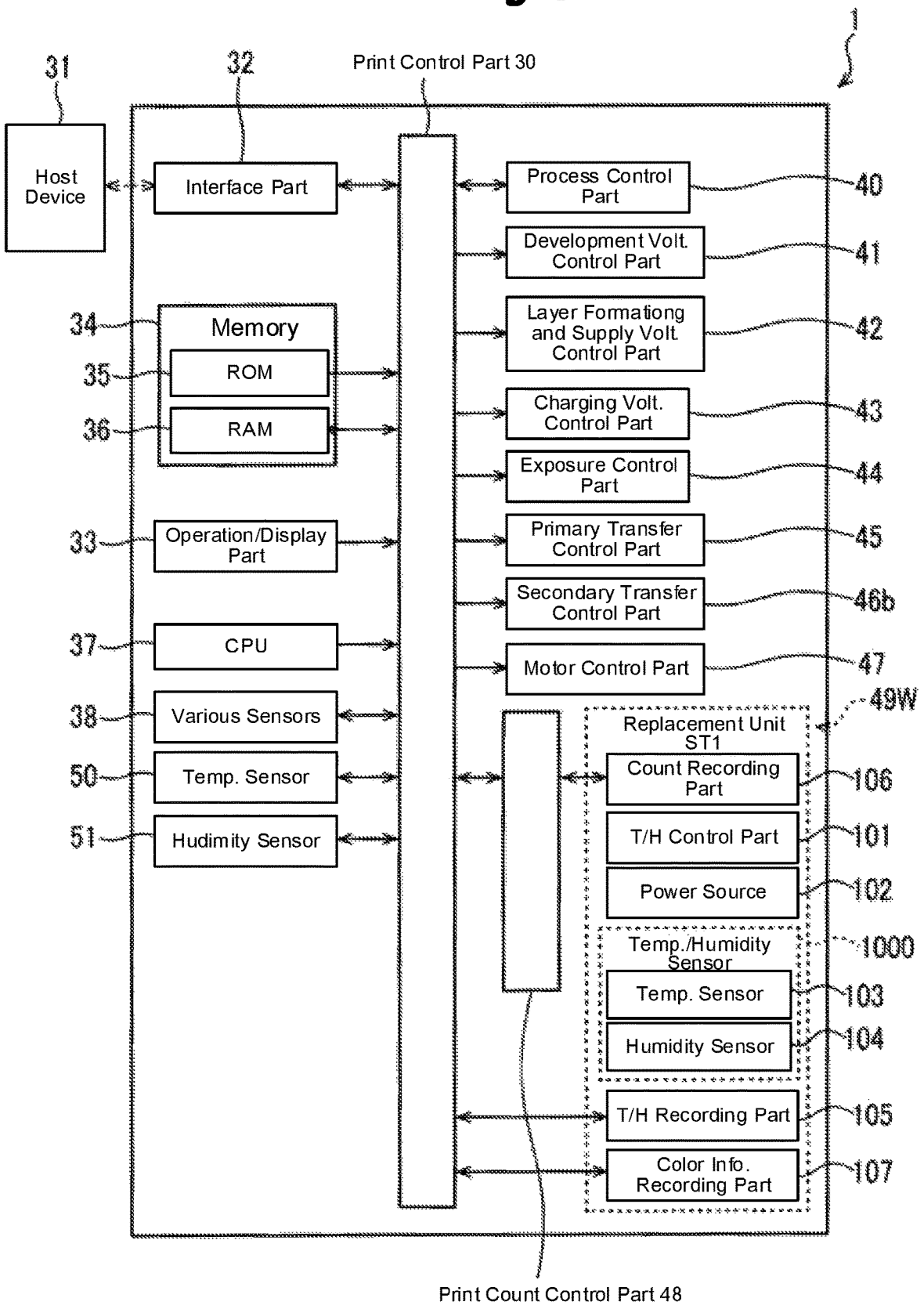
FIG. 5 is a block diagram showing the control configuration of the image forming apparatus in the first embodiment.

FIG. 5 is a block diagram showing the control configuration of the image forming apparatus 1 in the first embodiment. In FIG. 5, the image forming apparatus 1 has a print control part 30, a CPU (Central Processing Unit) 37, memory 34, the operation/display part 33, an interface part 32, various sensors 38, the temperature sensor 50, the humidity sensor 51, a process control part 40, a development voltage control part 41, a layer formation and supply voltage control part 42, a charging voltage control part 43, an exposure control part 44, a primary transfer control part 45, a secondary transfer control part 46*b*, a motor control part 47, and a print count control part 48. Also, the replacement unit ST1 has a temperature/humidity measurement system 49W.

The print control part 30 controls the operations of the whole image forming apparatus 1. The print control part 30 is connected with the CPU 37, the memory 34, the operation/display part 33, the interface part 32, the various sensors 38, the temperature sensor 50, the humidity sensor 51, the process control part 40, the development voltage control part 41, the layer formation and supply voltage control part 42, the charging voltage control part 43, the exposure control part 44, the primary transfer control part 45, the secondary transfer control part 46*b*, the motor control part 47, the print count control part 48, and the temperature/humidity measurement system 49W, among which information (signals) can be exchanged.

The CPU 37 is a control means and executes control programs (software) stored in the memory 34. The control parts such as the print control part 30 perform respective controls by the CPU 37 executing the control programs. The memory 34 has ROM (Read Only Memory) 35 and RAM (Random Access Memory) 36.

The ROM 35 is nonvolatile memory that stores the control programs and setting information for performing various controls such as the print control, and formulae and coefficients for performing various corrections. The RAM 36 is memory that temporarily stores control information necessary in performing the various controls. Also, stored in the memory 34 are below-mentioned charging voltages (FIG. 9) and supply voltages (FIG. 11) for temperature and humidity of the image forming apparatus 1.

Furthermore, recorded in the memory 34 are the toner wasting numbers related to a return control when a below-mentioned temperature difference detected by the image forming apparatus 1 and the replacement unit ST1 is $\Delta T>0$ (FIG. 12), charging voltage (CH) correction values $\Delta CH$ related to the return control when the temperature difference detected by the image forming apparatus 1 and the replacement unit ST1 is $\Delta T<0$ (FIG. 13), the charging voltage (CH) correction values $\Delta CH$ related to the return control when a humidity difference detected by the image forming apparatus 1 and the replacement unit ST1 is $\Delta H>0$ (FIG. 14), and supply voltage (SB) correction values $\Delta SB$ related to the return control when the humidity difference detected by the image forming apparatus 1 and the replacement unit ST1 is $\Delta H<0$ (FIG. 15). The toner wasting numbers are shown TWN in FIG. 12.

According to instructions from the print control part 30, the operation/display part 33 accepts input operations with the operation part and displays various information on the display part. According to instructions from the print control part 30, the interface part 32 performs communication with a host device 31 such as a PC (Personal Computer) connected via a communication circuit, such as receiving print data instructing printing from a host device 31.

The various sensors 38 detect the print medium. The temperature sensor 50 and the humidity sensor 51 as the second sensors detect temperature and humidity that constitute the ambient environment of the image forming apparatus 1 as the second environmental information.

The print control part 30 can input medium detection information from the various sensors 38, and information such as temperature and humidity of the image forming apparatus 1 from the second sensors. According to instructions from the print control part 30, the process control part 40 controls the development voltage control part 41, the layer formation and supply voltage control part 42, the charging voltage control part 43, the primary transfer control part 45, and the secondary transfer control part 46*b* mentioned below to adjust the individual voltages.

According to instructions of the process control part 40, the development voltage control part 41 controls the development voltages applied to the development rollers 15W, 15Y, 15M, 15C, and 15K of the image forming parts 10W, 10Y, 10M, 10C, and 10K, respectively.

According to instructions from the process control part 40, the layer formation and supply voltage control part 42 controls the supply voltages (may be abbreviated as SB in the embodiments) applied to the development blades 16W, 16Y, 16M, 16C, and 16K, and the supply rollers 17W, 17Y, 17M, 17C, and 17K of the image forming parts 10W, 10Y, 10M, 10C, and 10K shown in FIG. 1, respectively. According to instructions from the process control part 40, the charging voltage control part 43 controls the charging voltages (may be abbreviated as CH in the embodiments) applied to the charging rollers 13W, 13Y, 13M, 13C, and 13K of the image forming parts 10W, 10Y, 10M, 10C, and 10K shown in FIG. 1, respectively.

According to instructions from the print control part 30, the exposure control part 44 controls light exposure of the LED heads 14W, 14Y, 14M, 14C, and 14K of the image forming parts 10W, 10Y, 10M, 10C, and 10K shown in FIG. 1. According to instructions from the process control part 40, the primary transfer control part 45 as a transfer control part controls the primary transfer voltages applied to the primary transfer rollers 19W, 19Y, 19C, 19M, and 19K shown in FIG. 1.

According to instructions from the process control part 40, the secondary transfer control part 46*b* controls the secondary transfer voltage applied to the secondary transfer roller 27*b* shown in FIG. 1. According to instructions from the print control part 30, the motor control part 47 controls the photosensitive drum motor to rotate the photosensitive drums 12W, 12Y, 12M, 12C, and 12K of the image forming parts 10W, 10Y, 10M, 10C, and 10K, respectively. Also, according to instructions from the print control part 30, the motor control part 47 controls an intermediate transfer belt motor, a carrying motor, a fuser motor, etc. to rotate the intermediate transfer belt 9 of the transfer belt unit 25, the sheet feeding roller 21, the rollers of the carrying roller unit 22, the heat application roller 28 of the fuser unit 24, and the rollers of the ejection roller unit 26, etc.

According to instructions from the print control part 30, the print count control part 48 counts the number of printed sheets.

Figure 6:
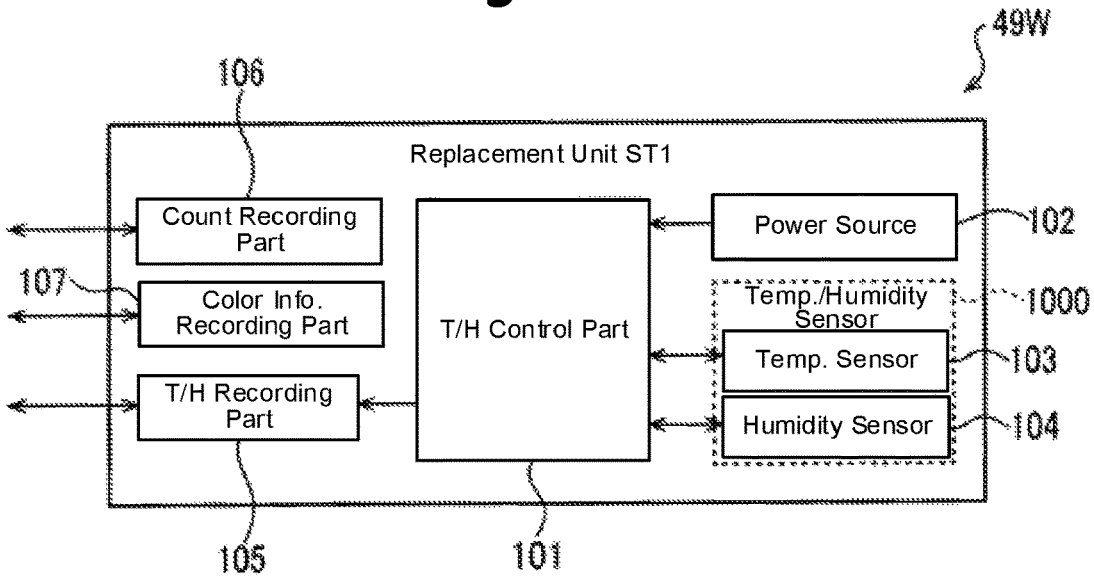
FIG. 6 is a block diagram showing the control configuration of a temperature/humidity measurement system of a replacement unit in the first embodiment.

FIG. 6 is a block diagram showing the control configuration of the temperature/humidity measurement system 49W of the replacement unit ST1 in the first embodiment. In FIG. 6, the temperature/humidity measurement system 49W of the replacement unit ST1 has a count recording part 106, a temperature/humidity control part 101, a temperature/humidity sensor 1000, a temperature/humidity recording part 105 (T/H recording part in FIG. 5), a power source 102, and a color information recording part 107.

The count recording part 106 records the number of printed sheets counted by the print count control part 48. The temperature/humidity control part 101 is connected with and controls the temperature/humidity sensor 1000 and the temperature/humidity recording part 105.

The temperature/humidity sensor 1000 has the temperature sensor 103 and the humidity sensor 104 and detects temperature and humidity that constitute the ambient environment of the replacement unit ST1. Although used as the temperature/humidity sensor 1000 in this embodiment is Hygrochron temperature/humidity logger manufactured by KN Laboratories, Inc., this invention is not limited to it, but a general-use temperature/humidity sensor 1000 and a general-use microcomputer can be combined and used. Note that the temperature detection range is −20~+70° C., and the humidity detection range is 0-95% RH.

According to instructions from the temperature/humidity control part 101, the temperature/humidity recording part 105 as a recording part records temperature and humidity detected by the temperature/humidity sensor 1000 and the detection time as environmental history information. The power source 102 is a battery (such as a button battery or an AA battery) and supplies power to the individual parts through the temperature/humidity control part 101.

Note that the battery is shipped out in an insulated state, and when the replacement unit ST1 is taken out of the image forming apparatus 1, an insulating film is pulled out by a user, thereby the temperature/humidity sensor 1000 starts detecting temperature and humidity. Note that if the battery life is longer than the life of the replacement unit ST1 (e.g., 2 years), the power can be turned on with no insulation from the manufacturing time, and temperature/humidity detection can be started when the replacement unit ST1 is taken out of the image forming apparatus 1.

Recorded in the color information recording part 107 is information on the color of the toner accommodated in the replacement unit ST1.

The actions of the above-mentioned configuration are explained.

In this embodiment, although the toners dealt with by the replacement units (ST1, ST2, ST3, ST4, and ST5) are different from one another, because their print operations are the same, the print operation of the image forming apparatus 1 is explained referring to FIGS. 1 through 6 with the white replacement unit ST1 as a representative.

The interface part 32 receives print data from the host device 31. Once the interface part 32 receives the print data, the print control part 30 starts the print operation. The print control part 30 controls the motor control part 47 to drive an unshown motor, thereby rotating the photosensitive drum 12W, the development roller 15W, and the supply roller 17W. Note that the charging roller 13W rotates following the photosensitive drum 12W.

The process control part 40 controls the charging voltage control part 43 to apply the charging voltage (CH) to the charging roller 13W. The charging roller 13W rotates in contact with and following the photosensitive drum 12W, uniformly charging the surface of the photosensitive drum 12W. The print control part 30 controls the exposure control part 44 to have the LED head 14W radiate light to form an electrostatic latent image on the surface of the photosensitive drum 12W based on the print data.

The supply roller 17W supplies toner to the surface of the development roller 15W. The toner supplied to the surface of the development roller 15W forms a uniform toner layer with its film thickness regulated by a shearing force of the development blade 16W. The toner on the development roller 15W adheres to the electrostatic latent image on the photosensitive drum 12W, forming the toner image.

The process control part 40 controls the primary transfer control part 45 to apply the primary transfer voltage to the primary transfer roller 19W. The toner image formed on the surface of the photosensitive drum 12W is primary-transferred to the surface of the intermediate transfer belt 9 by the primary transfer roller 19W.

The intermediate transfer belt 9, to which the toner image has been primary-transferred, rotates driven by the drive rollers 25*a* and 25*b*, therefore the toner image is carried to the secondary transfer nip part. The process control part 40 controls the secondary transfer control part 46*b* to apply the secondary transfer voltage to the secondary transfer roller 27*b*.

The toner image primary-transferred to the intermediate transfer belt 9 is secondary-transferred to the print medium in the secondary transfer nip part. The print medium, to which the toner image is transferred, is carried to the fuser unit 24.

The print medium carried to the fuser unit 24 is heated and pressed by being sandwiched by the heat application roller 28 and the pressure application roller 29 of the fuser unit 24, fusing the toner image to the print medium. The print medium, to which the toner image is fused, is ejected to the outside of the image forming apparatus 1 by the ejection roller unit 26, and stacked on the ejection cassette 2.

Here, the replacement unit ST1 that accommodates the special color may be removed from the image forming apparatus 1 when not used for printing. Then, by the replacement unit ST1 having been left alone in the ambient temperature/humidity environment outside the image forming apparatus 1, when printing is performed by attaching the replacement unit ST1 to the image forming apparatus 1 again, troubles may occur in the image.

The troubles mentioned here are troubles in the printed image such as fogging and dirtiness. Fogging is a phenomenon that toner with a lower charge amount than the normally-charged toner or toner charged in the opposite polarity adheres to the background part (non-image part) of the image. Dirtiness is a phenomenon that toner with a higher charge amount than the normally-charged toner, that is so-called excessively-charged toner, adheres to the background part (non-image part) of the image.

Figure 7:
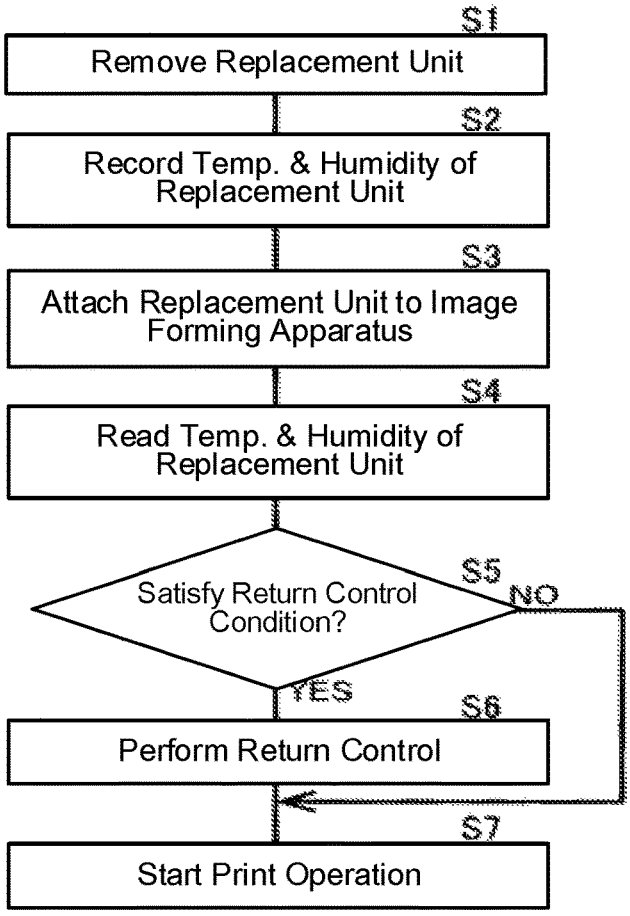
FIG. 7 is a flow chart showing the flow of a return control (or return processing) of the image forming apparatus in the first embodiment.

Then, in this embodiment, even when the replacement unit ST1 has been left alone in the ambient environment that may cause troubles to the printed image, by the print control part 30 performing the return control based on the detection result of the temperature/humidity sensor 1000, the troubles of the printed image are suppressed. Next, the return control of the image forming apparatus 1 in the first embodiment is explained referring to FIGS. 1 through 6 according to steps indicated with S in the flow chart showing the flow of the return control of the image forming apparatus 1 in the first embodiment in FIG. 7.

S1: The replacement unit ST1 is removed from the image forming apparatus 1.

Once the replacement unit ST1 is removed from the image forming apparatus 1, and the insulating film of the battery constituting the temperature/humidity measurement system 49W is pulled out, the temperature/humidity sensor 1000 attached to the toner cartridge 18W or the image forming part 10W constituting the replacement unit ST1 starts detecting temperature and humidity. In this manner, the temperature/humidity sensor 1000 detects temperature and humidity that constitute the ambient environment of the replacement unit ST1 left alone outside the image forming apparatus 1. Also, the temperature/humidity sensor 1000 detects temperature and humidity every hour for example.

S2: According to instructions of the temperature/humidity control part 101, the temperature/humidity recording part 105 constituting the temperature/humidity measurement system 49W records the detected temperature and humidity and the detection time. Data to be recorded in the temperature/humidity recording part 105 are for one year for example, recording the maximum temperature and the minimum temperature, and the maximum humidity and the minimum humidity.

S3: The replacement unit ST1 is attached to the image forming apparatus 1.

S4: The print control part 30 of the image forming apparatus 1 has the reading part 1002 read the environmental history information recorded in the temperature/humidity recording part 105 of the replacement unit ST1.

S5: The print control part 30 judges whether the environmental history information satisfies a return control condition, moves to S6 if the return control condition is satisfied or S7 if the return control condition is not satisfied, and starts the print operation.

S6: The print control part 30 performs the return control.

S7: The print operation is started.

Here, because the return control condition (S5) and the return control (S6) differ according to the environmental history information recording in the temperature/humidity recording part 105, the details are explained below.

FIG. 8 is a list showing an example of the memory record information of the temperature/humidity recording part 105 in the first embodiment. Shown in FIG. 8 are four cases as the memory record information corresponding to the environmental history information.

Note that explanations in this embodiment are given assuming that the replacement unit ST1 left alone outside the image forming apparatus 1 was attached to the image forming apparatus 1 at 11:00:00 on Oct. 17 in 2018 as the current time. Also, the values detected by the temperature sensor 50 and the humidity sensor 51 of the image forming apparatus 1 are assumed to be temperature 24° C. and humidity 50% RH. The print control part 30 starts the print operation after performing different return controls according to the individual pieces of the environmental history information listed in the memory record information 1 through 4 in FIG. 8.

[Case of Memory Record Information 1] After having been left alone in the ambient environment of temperature 10° C., the replacement unit ST1 was attached to the image forming apparatus 1 at the current time.

That is, the replacement unit ST1 may have dew condensation due to a rapid temperature change from 10° C. to 24° C. If the replacement unit ST1 is allowed to perform the print operation, soft agglomeration of toner due to dew condensation may occur inside the image forming part 10W, thereby generating streaks in the image, and dirtiness may occur due to a decrease in the charging voltage (CH).

Then, the print control part 30 reads temperature and humidity recorded in the temperature/humidity recording part 105 constituting the temperature/humidity measurement system 49W installed in the replacement unit ST1, and if the temperature difference between the minimum temperature while it was left alone and the current temperature is 12° C. or higher, performs the return control, and afterwards starts the print operation.

As the return control, the print control part 30 has the operation/display part 33 display a message that the replacement unit ST1 should rest for 6 hours for example to dry the replacement unit ST1, suppressing image trouble occurrences.

Note that this invention is not limited to the above-mentioned return control, but along with having the operation/display part 33 display the resting time for the replacement unit ST1, the print control part 30 can instruct the fuser unit 24 to heat the heat application roller 28 for promoting the drying of the replacement unit ST1 having dew condensation, thereby reducing the resting time. Note that although adopted as the return control condition in this embodiment was that the temperature difference between the minimum temperature while left alone and the current temperature was a certain value or higher (e.g., 12° C. or higher), this invention is not limited to this.

[Case of Memory Record Information 2] After having been left alone for a long time in a high-humidity environment of humidity 75% RH or higher, the replacement unit ST1 was attached to the image forming apparatus 1 at the current time.

That is, because the replacement unit ST1 was left alone for a long time in a high-humidity environment, if the replacement unit ST1 is allowed to perform the print operation as it is, fogging may occur in the printed image. Then, the print control part 30 reads temperature, humidity, and detection time recorded in the temperature/humidity recording part 105 constituting the temperature/humidity measurement system 49W installed in the replacement unit ST1, and if the replacement unit ST1 was left alone in the ambient environment of humidity 75% RH for 6 hours or more within the last 12 hours, performs the return control, and afterwards starts the print operation.

As the return control, the print control part 30 controls the motor control part 47 to idle the development roller 15W for 30 seconds, thereby increasing the charge amount of the lowly-charged toner and suppressing fogging occurrences.

Note that instead of being limited to the above-mentioned return processing, the print control part 30 can instruct the process control part 40 to lower the voltage applied to the charging roller 13W from −970 V to −940 V for example, or rotate the development roller 15W to waste toner for one round of the development roller 15W, thereby suppressing fogging occurrences. Also, the above-mentioned return controls may be performed in combination with each other. Note that adopted as the condition for performing the return control in this embodiment was that the replacement unit ST1 was left alone in the ambient environment of humidity 75% RH for 6 hours or more within the last 12 hours, this invention is not limited to this.

[Case of Memory Record Information 3] After having been left alone in the ambient environment near the toner solidifying temperature of 45° C. or higher, the replacement unit ST1 was attached to the image forming apparatus 1 at the current time.

The toner solidifying temperature is temperature where toner starts to agglomerate (45° C. in this embodiment). That is, by having been left alone near the toner solidifying temperature, toner may be solidified inside the replacement unit ST1. If the replacement unit ST1 is allowed to perform the print operation as it is, not only image troubles may occur, but also the gears that drive the replacement unit ST1 may not move, disabling printing.

Then, the print control part 30 reads temperature and humidity recorded in the temperature/humidity recording part 105 constituting the temperature/humidity measurement system 49W installed in the replacement unit ST1, performs a first return control if the maximum temperature is 40° C. or higher and lower than 45° C., a second return control if the maximum temperature is 45° C. or higher and lower than 50° C., or a third return control if the maximum temperature is 50° C. or higher, and afterwards starts the print operation.

As the first return control, the print control part 30 controls the motor control part 47 to idle the development roller 15W for 30 seconds, thereby suppressing toner solidification by loosening soft-agglomerated toner. As the second return control, the print control part 30 rotates the development roller 15W to waste toner for 2 rounds of the development roller 15W at an area ratio 50% duty, thereby wasting toner between the development roller 15W and the development blade 16W where toner can agglomerate most easily.

As the third return control, the print control part 30 has the operation/display part 33 display a message that the replacement unit ST1 should be replaced for example, thereby preventing troubles of the image forming apparatus 1. Note that although set as the return control condition in this embodiment was the case where the maximum temperature is 40° C. or higher and lower than 45° C., the case where the maximum temperature is 45° C. or higher and lower than 50° C., or the case where the maximum temperature is 50° C. or higher, this invention is not limited to this.

[Case of Memory Record Information 4] After having been left alone in a low-humidity environment of humidity 20% RH or lower, the replacement unit ST1 was attached to the image forming apparatus 1 at the current time.

That is, because the replacement unit ST1 was left alone in the low-humidity environment, toner can easily become highly charged, and if the replacement unit ST1 is allowed to perform the print operation as it is, troubles may occur in the image. Then, the print control part 30 reads temperature and humidity recorded in the temperature/humidity recording part 105 constituting the temperature/humidity measurement system 49W installed in the replacement unit ST1, if humidity in the most recent record is 20% RH or lower, performs the return control, and afterwards starts the print operation.

As the return control, the print control part 30 instructs the process control part 40 to lower the supply voltage (SB) applied to the supply roller 17W from −400 V to −380 V for example, thereby suppressing the occurrences of troubles in the printed images. Note that although set as the condition for performing the return control in this embodiment was that humidity in the most recent record was a certain value or lower (e.g., 20% RH or lower), this invention is not limited to this.

In this manner, in the first embodiment, the replacement unit ST1 employs the temperature/humidity sensor 1000 to detect temperature and humidity as the ambient environment while it was taken out from the image forming apparatus 1 and left alone, and records the detected temperature and humidity and the detection time by the temperature/humidity recording part 105, and the image forming apparatus 1 employs the print control part 30 to perform the return control based on temperature and humidity recorded in the temperature/humidity recording part 105 of the replacement unit ST1, thereby high-quality images with no image troubles can be obtained even when the replacement unit ST1 was left alone for a long time.

As explained above, in the first embodiment, by performing the return control based on temperature and humidity detected by the replacement unit ST1, obtained is an effect that high-quality images with no image troubles can be obtained even when the replacement unit ST1 was left alone for a long time.

Embodiment 2

Because the configuration of the second embodiment is the same as that of the first embodiment, the same codes are used, and their explanations are omitted. In the first embodiment, the print operation is started after performing the return control based on the detection result of the temperature/humidity sensor 1000 of the replacement unit ST1. However, because temperature of humidity of the replacement unit ST1 exposed to the ambient environment of the image forming apparatus 1 are different from temperature and humidity of the image forming apparatus 1, until they reach similar degrees of temperature and humidity, troubles may occur in the printed images, and therefore the return control needs to be continued.

Furthermore, in the image forming apparatus 1 of Embodiment 1 mentioned above, based on the ambient environment (temperature and humidity) of the image forming apparatus 1, the charging voltage (CH) was determined from FIG. 9 in performing the return control. Note that FIG. 9 is a table explaining the charging voltage (CH) for temperature and humidity of the image forming apparatus 1.

For example, it is assumed that the ambient environment of the image forming apparatus 1 was detected by the temperature sensor 50 and the humidity sensor 51 as 20° C. and 55% RH, and the ambient environment of the replacement unit ST1 attached to the image forming apparatus 1 after having been left alone in a low-temperature ambient environment of 5° C. was detected by the temperature/humidity sensor 1000 as 5° C. and 55% RH.

According to FIG. 9, the charging voltage (CH) applied to the charging roller 13W becomes −770 V based on the ambient environment (temperature and humidity) of the image forming apparatus 1, and the charging voltage (CH) applied to the charging roller 13W becomes −785 V based on the ambient environment (temperature and humidity) of the replacement unit ST1, therefore the charging voltage (CH) applied for performing the appropriate return control is different between the image forming apparatus 1 and the replacement unit ST1.

In this case, in the image forming apparatus 1 of Embodiment 1 mentioned above, although the charging voltage (CH) is determined to be −770 V based on the ambient environment (temperature and humidity) of the image forming apparatus 1, because the appropriate charging voltage (CH) of −785 V is not applied to the replacement unit ST1, troubles may occur in the printed images.

Then, in the second embodiment, based on temperature and humidity differences between an image forming apparatus 1 and a replacement unit ST1, return controls shown in FIGS. 12 through 15 mentioned below are performed. Furthermore, although an expensive and high-durability sensor is used as a temperature sensor 50 of the image forming apparatus 1, because an inexpensive and low-durability sensor is used as a temperature sensor 50 of the replacement unit ST1, it is better to use temperature and humidity differences between the image forming apparatus 1 and the replacement unit 1 for performing the stable return control.

Actions of the above-mentioned configuration are explained.

Figure 10:
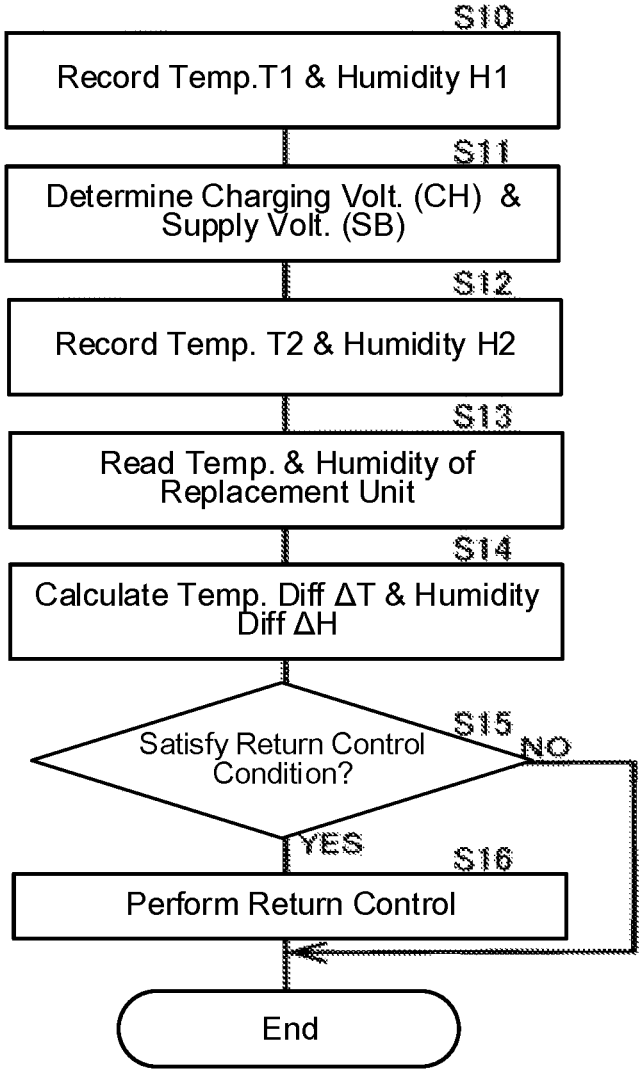
FIG. 10 is a flow chart showing the flow of a return control (or return processing) of an image forming apparatus based on temperature and humidity differences in the second embodiment.

A return control (or return processing) of the image forming apparatus 1 based on temperature and humidity differences in this embodiment is explained referring to FIGS. 1 through 9 according to steps indicated with S in a flow chart in FIG. 10 showing the flow of the return control of the image forming apparatus 1 based on temperature and humidity differences in the second embodiment.

S10: A print control part 30 of the image forming apparatus 1 has memory 34 store temperature T1 and humidity H1 detected by the temperature sensor 50 and a humidity sensor 51.

S11: Based on temperature and humidity of the image forming apparatus 1 recorded in the memory 34 in S1, the print control part 30 of the image forming apparatus 1 determines a charging voltage (CH) and a supply voltage (SB) that become reference values from FIGS. 9 and 11. Note that FIG. 11 is a table explaining supply voltage (SB) for temperature and humidity of the image forming apparatus 1.

S12: According to instructions of a temperature/humidity control part 101, a temperature/humidity recording part 105 of the replacement unit ST1 records temperature T2 and humidity H2 detected by a temperature/humidity sensor 1000.

S13: The print control part 30 of the image forming apparatus 1 has a reading part 1002 read memory record information recorded in the temperature/humidity recording part 105 of the replacement unit ST1.

S14: The print control part 30 of the image forming apparatus 1 calculates the temperature difference between the temperature T2 of the replacement unit ST1 and the temperature T1 of the image forming apparatus 1 ($\Delta T = T2 - T1$), and the humidity difference between the humidity H2 of the replacement unit ST1 and the humidity H1 of the image forming apparatus 1 (ΔH=H2−H1).

S15: The print control part 30 of the image forming apparatus 1 judges whether either the temperature difference ΔT or the humidity difference ΔH between the replacement unit ST1 and the image forming apparatus 1 satisfies a return control condition, and moves to S16 if the return control condition is satisfied, or ends this process if the return control condition is not satisfied.

Here, if it is assumed for example that the ambient environment of the image forming apparatus 1 is 24° C. and 50% RH, it is determined from FIGS. 9 and 11 in S11 that the charging voltage (CH) is −770 V and the supply voltage (SB) is −200 V.

However, as mentioned above, due to either the temperature difference or the humidity difference detected by the image forming apparatus 1 and the replacement unit ST1, there are cases where the appropriate charging voltage (CH) is not applied to a charging roller 13W, the appropriate supply voltage (SB) is not applied to a supply roller 17W, and troubles occur in the printed images. Then, the print control part 30 of the image forming apparatus 1 judges whether either the temperature difference ΔT detected by the image forming apparatus 1 and the replacement unit ST1 or the humidity difference ΔH detected by the image forming apparatus 1 and the replacement unit ST1 satisfies the return control condition.

Note that the return control condition has cases of ΔT>0, ΔT<0, ΔH>0, and ΔH<0 mentioned below.

S16: The print control part 30 of the image forming apparatus 1 performs the return control shown in FIGS. 12 through 15 according to the return control condition satisfied by the temperature difference ΔT detected by the image forming apparatus 1 and the replacement unit ST1 or the humidity difference ΔH detected by the image forming apparatus 1 and the replacement unit ST1.

Below, explained are the details of the return control shown in FIGS. 12 through 15 according to the return control condition.

[Case of ΔT>0] FIG. 12 is a table explaining the return control in the case where the temperature difference detected by the image forming apparatus 1 and the replacement unit ST1 in the second embodiment is ΔT>0.

If the temperature difference detected by the image forming apparatus 1 and the replacement unit ST1 is ΔT>0, that is, if the temperature T2 of the replacement unit ST1 is higher than the temperature T1 of the image forming apparatus 1, dirtiness may occur in the printed images due to an increase in the amount of adhering toner.

Then, as shown in FIG. 12, the print control part 30 performs a first return control if the temperature difference detected by the image forming apparatus 1 and the replacement unit ST1 is 5° C.≤ΔT<10° C., a second return control if 10° C.≤ΔT≤15° C., a third return control if 15° C.≤ΔT<20° C., and a fourth return control if ΔT≥20° C. to suppress the occurrences of dirtiness in the printed images.

As the first return control, the print control part 30 rotates a development roller 15W to waste toner for 5 rounds of the development roller 15W according to FIG. 12. As the second return control, the print control part 30 rotates the development roller 15W to waste toner for 10 rounds of the development roller 15W according to FIG. 12. As the third return control, the print control part 30 rotates the development roller 15W to waste toner for 15 rounds of the development roller 15W according to FIG. 12. As the fourth return control, the print control part 30 rotates the development roller 15W to waste toner for 20 rounds of the development roller 15W according to FIG. 12.

Note that although set as the return control condition in this embodiment were the case where the temperature difference detected by the image forming apparatus 1 and the replacement unit ST1 was 5° C.≤ΔT<10° C., the case where 10° C.≤ΔT<15° C., the case where 15° C.≤ΔT<20° C., and the case where ΔT≥20° C., this invention is not limited to this. Note that if (T1+ΔT)≥50° C., that is, if the temperature T1 is 50° C. or higher, the operation is stopped because troubles may occur to the image forming apparatus 1.

[Case of ΔT<0] FIG. 13 is a table explaining the return control when the temperature difference detected by the image forming apparatus 1 and the replacement unit ST1 in the second embodiment is ΔT<0.

For example, if the ambient environment of the image forming apparatus 1 is assumed to be 24° C. and 50% RH, in the image forming apparatus 1 by the first embodiment mentioned above, the charging voltage (CH)=−770 V, which is the reference value determined from FIG. 9 in S11 in FIG. 10, is applied to the charging roller 13W.

However, if the temperature difference detected by the image forming apparatus 1 and the replacement unit ST1 is ΔT<0, that is, if the temperature T2 of the replacement unit ST1 is lower than the temperature T1 of the image forming apparatus 1, dirtiness may occur in the printed images due to a decrease in the surface potential of a photosensitive drum 12W.

Then, in FIG. 13, the print control part 30 performs a first return control if the temperature difference detected by the image forming apparatus 1 and the replacement unit ST1 is −10° C.<ΔT≤−5° C., a second return control if −15° C.<ΔT≤−10° C., a third return control if −20° C.<ΔT≤−15° C., and a fourth return control if ΔT≤−20° C. to suppress the occurrences of dirtiness in the printed images.

As the first return control, the print control part 30 determines a correction value ΔCH (−4 V) for the charging voltage (CH) from FIG. 13, instructs a process control part 40 to correct the reference charging voltage (CH)=−770 V, and applies −774 V (−770 V+(−4 V)) to the charging roller 13W. As the second return control, the print control part 30 determines the correction value ΔCH (−8 V) for the charging voltage (CH) from FIG. 13, instructs the process control part 40 to correct the reference charging voltage (CH)=−770 V, and applies −778 V (−770 V+(−8 V)) to the charging roller 13W.

As the third return control, the print control part 30 determines the correction value ΔCH (−12 V) for the charging voltage (CH) from FIG. 13, instructs the process control part 40 to correct the reference charging voltage (CH)=−770 V, and applies −782 V (−770 V+(−12 V)) to the charging roller 13W. As the fourth return control, the print control part 30 determines the correction value ΔCH (−16 V) for the charging voltage (CH) from FIG. 13, instructs the process control part 40 to correct the reference charging voltage (CH)=−770 V, and applies −786 V (−770 V+(−16 V)) to the charging roller 13W.

Note that although set as the return control condition in this embodiment were the case where the temperature difference detected by the image forming apparatus 1 and the replacement unit ST1 was −10° C.<ΔT≤−5° C., the case where −15° C.<ΔT≤−10° C., the case where −20° C.<ΔT≤−15° C., and the case where ΔT≤−20° C., this invention is not limited to this. Note that if (T1+ΔT)≤0° C., that is, if the temperature T1 is 0° C. or lower, the operation of the image forming apparatus 1 is stopped in order to prevent dirtiness from occurring due to a decrease in the surface potential of the photosensitive drum 12W.

[Case of ΔH>0] FIG. 14 is a table explaining the return control when the humidity difference detected by the image forming apparatus 1 and the replacement unit ST1 in the second embodiment is ΔH>0.

For example, if the ambient environment of the image forming apparatus 1 is assumed to be 24° C. and 50% RH, in the image forming apparatus 1 by the first embodiment mentioned above, the charging voltage (CH)=−770 V, which is the reference value determined from FIG. 9 in S11 in FIG. 10, is applied to the charging roller 13W.

However, if the humidity difference detected by the image forming apparatus 1 and the replacement unit ST1 is ΔH>0, that is, if the humidity H2 of the replacement unit ST1 is higher than the humidity H1 of the image forming apparatus 1, fogging may occur in the printed images due to a decrease in the toner charge amount.

Then, as shown in FIG. 14, the print control part 30 performs a first return control if the humidity difference detected by the image forming apparatus 1 and the replacement unit ST1 is 10% RH<ΔH≤20% RH, a second return control if 20% RH<ΔH≤30% RH, a third return control if 30% RH<ΔH≤40% RH, and a fourth return control if ΔH≥50% RH to suppress the occurrences of fogging in the printed images.

As the first return control, the print control part 30 determines the correction value ΔCH (+4 V) for the charging voltage (CH) from FIG. 14, instructs the process control part 40 to correct the reference charging voltage (CH)=−770 V, and applies −766 V (−770 V+(+4 V)) to the charging roller 13W. As the second return control, the print control part 30 determines the correction value ΔCH (+8 V) for the charging voltage (CH) from FIG. 14, instructs the process control part 40 to correct the reference charging voltage (CH)=−770 V, and applies −762 V (−770 V+(+8 V)) to the charging roller 13W.

As the third return control, the print control part 30 determines the correction value ΔCH (+12 V) for the charging voltage (CH) from FIG. 14, instructs the process control part 40 to correct the reference charging voltage (CH)=−770 V, and applies −758 V (−770 V+(+12 V)) to the charging roller 13W. As the fourth return control, the print control part 30 determines the correction value ΔCH (+16 V) for the charging voltage (CH) from FIG. 14, instructs the process control part 40 to correct the reference charging voltage (CH)=−770 V, and applies −754 V (−770 V+(+16 V)) to the charging roller 13W.

Note that although set as the return control condition in this embodiment were the case where the humidity difference detected by the image forming apparatus 1 and the replacement unit ST1 was 10% RH<ΔH≤20% RH, the case where 20% RH<ΔH≥30% RH, the case where 30% RH<ΔH≤40% RH, and the case where ΔH≥50% RH, this invention is not limited to this. Note that if (H1+ΔH)≥90% RH, that is, if the humidity H1 is 90% RH or higher, the operation of the image forming apparatus 1 is stopped in order to prevent streaks from occurring in the printed images due to dew condensation.

[Case of ΔH<0] FIG. 15 is a table explaining the return control when the humidity difference detected by the image forming apparatus 1 and the replacement unit ST1 in the second embodiment is ΔH<0.

For example, if the ambient environment of the image forming apparatus 1 is assumed to be 24° C. and 50% RH, in the image forming apparatus 1 by the first embodiment mentioned above, the supply voltage (SB)=−200 V, which is the reference value determined from FIG. 11 in S11 in FIG. 10, is applied to the supply roller 17W.

However, if the humidity difference detected by the image forming apparatus 1 and the replacement unit ST1 is ΔH<0, that is, if the humidity H2 of the replacement unit ST1 is lower than the humidity H1 of the image forming apparatus 1, dirtiness may occur in the printed images due to an increase in the toner charge amount.

Then, as shown in FIG. 15, the print control part 30 performs a first return control if the humidity difference detected by the image forming apparatus 1 and the replacement unit ST1 is −20% RH≤ΔH<−10% RH, a second return control if −30% RH≤ΔH<−20% RH, a third return control if −40% RH≤ΔH<−30% RH, and a fourth return control if ΔH≤−50% RH to suppress the occurrences of dirtiness in the printed images.

As the first return control, the print control part 30 determines the correction value ΔSB (+5 V) for the supply voltage (SB) from FIG. 15, instructs the process control part 40 to correct the reference supply voltage (SB)=−200 V, and applies −195 V (−200 V+(+5 V)) to the supply roller 17W. As the second return control, the print control part 30 determines the correction value ΔSB (+10 V) for the supply voltage (SB) from FIG. 15, instructs the process control part 40 to correct the reference supply voltage (SB)=−200 V, and applies −190 V (−200 V+(+10 V)) to the supply roller 17W As the third return control, the print control part 30 determines the correction value ΔSB (+15 V) for the supply voltage (SB) from FIG. 15, instructs the process control part 40 to correct the reference supply voltage (SB)=−200 V, and applies −185 V (−200 V+(+15 V)) to the supply roller 17W. As the fourth return control, the print control part 30 determines the correction value ΔSB (+20 V) for the supply voltage (SB) from FIG. 15, instructs the process control part 40 to correct the reference supply voltage (SB)=−200 V, and applies −180 V (−200 V+(+20 V)) to the supply roller 17W.

Note that although set as the return control condition in this embodiment were the case where the humidity difference detected by the image forming apparatus 1 and the replacement unit ST1 is −20% RH≤ΔH<−10% RH, the case where −30% RH≤ΔH<−20% RH, the case where −40% RH≤ΔH<−30% RH, and the case where ΔH≤−50% RH, this invention is not limited to this.

Note that although the print control part 30 of the image forming apparatus 1 in this embodiment determined the correction value for the supply voltage (SB) according to the humidity difference detected by the image forming apparatus 1 and the replacement unit ST1, and instructed the process control part 40 to correct the supply voltage (SB) applied to the supply roller 17W, this invention is not limited to it, but the occurrences of dirtiness in the printed images can also be suppressed by modifying it so that the print control part 30 of the image forming apparatus 1 determines a correction value for the development voltage according to the temperature difference or the humidity difference detected by the image forming apparatus 1 and the replacement unit ST1, and instructs the process control part 40 to correct the development voltage applied to the development roller 15W.

In this manner, in the second embodiment, the replacement unit ST1 employs the temperature/humidity sensor 1000 to detect temperature and humidity, the temperature/humidity recording part 105 records the detected temperature and humidity, and the image forming apparatus 1 employs the temperature sensor 50 and the humidity sensor 51 to detect temperature and humidity, and performs the return control based on the temperature difference or the humidity difference between the image forming apparatus 1 and the replacement unit ST1, thereby image troubles due to the temperature difference or the humidity difference between the image forming apparatus 1 and the replacement unit ST1 can be suppressed, and high-quality images can be obtained.

As explained above, in the second embodiment, by performing the return control based on the temperature difference or the humidity difference between the image forming apparatus 1 and the replacement unit ST1, in addition to the effect of the first embodiment, obtained is an effect that high-quality images can be obtained by suppressing image troubles due to the temperature difference or the humidity difference between the image forming apparatus 1 and the replacement unit ST1.

Note that although the explanations in the first embodiment and the second embodiment were given assuming the image forming apparatus 1 was a printer, this invention is not limited to it, but it can be a copier, a facsimile machine, a multifunction peripheral (MFP), or the like. Also, although the temperature/humidity measurement system 49W is attached to the replacement unit ST1 in the first embodiment and the second embodiment, temperature and humidity during the left-alone time can be grasped by attaching only the temperature/humidity recording part 105 to the replacement unit ST1 and attaching the temperature sensor 103, the humidity sensor 104, the power source 102, etc. to a storage box for the replacement unit ST1.

Also, although adopted in the first embodiment and the second embodiment was the temperature/humidity measurement system 49W, it can be separated into a temperature measurement system that grasps only temperature by removing the humidity sensor 104, and a humidity measurement system that grasps only humidity by removing the temperature sensor 103 to grasp temperature and humidity individually, thereby suppressing the system cost. Note that this invention is not limited to the above-mentioned embodiments, but various modifications are possible based on the purpose of this invention, and they are not excluded from the scope of this invention.

What is claimed is:

1. An image forming apparatus comprising an apparatus main body and a replacement unit that is detachable to the apparatus main body, wherein the replacement unit comprises a power source that supplies electric power while the replace unit is physically detached from the apparatus main body, a first sensor that detects first environmental information that is an ambient environment of the replacement unit, the first sensor running by the electric power supplied from the power source, and a recording part that records the first environmental information as environmental history information wherein the first environmental information is detected and stored therein while the replacement unit is detached from the apparatus main body, the apparatus main body comprises a second sensor that detects second environmental information that is another ambient environment of the apparatus main body, and a control part that controls the replacement unit based on the environmental history information and the second environmental information, when the replacement unit is attached to the apparatus main body, the control part performs a return control based on the environmental history information and the second environmental information.

2. The image forming apparatus according to claim 1, wherein if a difference between the environmental history information and the second environmental information is a specified threshold or greater, the control part performs the return control, and if the difference between the environmental history information and the second environmental information is less than the specified threshold, the control part does not perform the return control.

3. The image forming apparatus according to claim 1, wherein the replacement unit is configured with an accommodation part that accommodates a developer, and an image forming part that forms a developer image using the developer.

4. The image forming apparatus according to claim 1, further comprising:

an image carrier that carries an electrostatic latent image, a charging part that charges a surface of the image carrier, a development unit that develops the electrostatic latent image by having a developer adhere to the electrostatic latent image, a supply part that supplies the developer to the development part, and a process control part that adjusts at least one of voltages applied to the charging part, the development part, and the supply part, the one of voltages being defined as a specific applied voltage, wherein the control part performs the return control by changing the specific applied voltage based on the environmental history information and the second environmental information.

5. The image forming apparatus according to claim 4, further comprising:

a transfer part that transfers the developer image to a transfer medium, and a transfer control part that applies a voltage to the transfer part, wherein the control part performs the return control by changing a number of wasting the developer transferred to the transfer medium before starting an image forming based on the environmental history information and the second environmental information.

6. The image forming apparatus according to claim 1, wherein the first environmental information and the second environmental information are made with temperature and humidity.

7. The image forming apparatus according to claim 6, wherein if at least one prescribed temperature, which is within a predetermined range, is recorded in the environmental history information, which is obtained before the replacement unit is attached, the control part performs an action for prompting to replace the replacement unit attached to the apparatus main body.

8. The image forming apparatus according to claim 3, wherein the first sensor is placed at the accommodation part of the replacement unit in order to periodically measure either temperature or humidity inside accommodation part wherein these periodically measured temperature or humidity are defined as measured data, the recording part that records the measured data and timing data at which these measured data are generated, creating the environmental history information by linking the measured data and the timing data.

9. The image forming apparatus according to claim 4, wherein the return control is one of actions following:

to display a message to leave the replacement unit alone for a predetermined period, to heat the replacement unit for a predetermined period, to activate the development part without charging a voltage on its surface.

10. The image forming apparatus according to claim 4, wherein if a difference between the environmental history information and the second environmental information is a specified threshold or greater, the control part performs the return control, and if the difference between the environmental history information and the second environmental information is less than the specified threshold, the control part does not perform the return control, the control part determines a correction value by considering the difference between the environmental history information and the second environmental information, the control part adjusts the specific applied voltage by adding the correction value when performing the return control, and as the difference is larger, the correction value increases.

11. An image forming apparatus comprising an apparatus main body and a replacement unit that is detachable to the apparatus main body, wherein the replacement unit comprises a power source that supplies electric power while the replace unit is physically detached from the apparatus main body, a first sensor that detects first environmental information that is an ambient environment of the replacement unit, the first sensor running by the electric power supplied from the power source, and a recording part that records the first environmental information as environmental history information wherein the first environmental information is detected and stored therein while the replacement unit is detached from the apparatus main body, the apparatus main body comprises a control part that controls the replacement unit based on the environmental history information, and when the replacement unit is attached to the apparatus main body, the control part performs a return control based on the environmental history information.

12. The image forming apparatus according to claim 11, provided with an image carrier that carries an electrostatic latent image, a charging part that charges the surface of the image carrier, a development part that develops the electrostatic latent image by having a developer adhere to the electrostatic latent image, a supply part that supplies a developer to the development part, and a process control part that adjusts at least one of voltages applied to the charging part, the development part, and the supply part, the one of voltages being defined as a specific applied voltage, wherein the control part performs the return control by changing the specific applied voltage based on the environmental history information.

13. The image forming apparatus according to claim 11, wherein the apparatus main body is provided with a secondary transfer part that transfers the developer image to a medium, and a fuser part that fuses the developer image to the medium, and once the replacement unit is attached to the apparatus main body, the control part increases heating temperature of the fuser part based on the environmental history information before the attaching action.

14. The image forming apparatus according to claim 6, wherein the first environmental information further includes detection time when the temperature and the humidity were detected, and the recording part records data including the temperature, the humidity and the detection time.

15. The image forming apparatus according to claim 14, wherein the data recorded in the recording part includes a maximum temperature and a minimum temperature, and a maximum humidity and a minimum temperature.

16. The image forming apparatus according to claim 11, wherein the first environmental information as environmental history information includes data including temperature and humidity detected by the first sensor and detection time when the temperature and the humidity were detected.

17. The image forming apparatus according to claim 16, wherein the data recorded in the recording part includes a maximum temperature and a minimum temperature, and a maximum humidity and a minimum temperature.

18. The image forming apparatus according to claim 1, wherein the second sensor is activated by electric power, which is other than the electric power supplied from the power source, supplied from an outside the image forming apparatus to the second sensor.

19. The image forming apparatus according to claim 1, wherein the power source is composed with one or more batteries.

* * * * *